US005383334A

United States Patent [19]

Kaminishizono et al.

[11] Patent Number: 5,383,334

[45] Date of Patent: Jan. 24, 1995

[54] COMPRESSOR INTEGRAL WITH STIRLING ENGINE

[75] Inventors: Takeyoshi Kaminishizono, Chiryu; Tetsumi Watanabe, Okazaki; Yutaka Momose, Anjo, all of Japan

[73] Assignee: Aisin Seiki Kabushiki Kaisha, Kariya, Japan

[21] Appl. No.: 76,639

[22] Filed: Jun. 15, 1993

[30] Foreign Application Priority Data

Jun. 22, 1992 [JP] Japan ..... 4-162767

[51] Int. Cl.[6] ..... F02G 1/043

[52] U.S. Cl. ..... 60/517; 417/473; 417/379

[58] Field of Search ..... 60/517-526; 417/473, 379, 393, 394

[56] References Cited

U.S. PATENT DOCUMENTS

| | | | |
|---|---|---|---|
| 4,450,685 | 5/1984 | Corey | 60/520 |
| 4,751,819 | 6/1988 | Eder | 60/517 |
| 5,088,284 | 2/1992 | Momose | 60/517 |

*Primary Examiner*—Ira S. Lazarus
*Assistant Examiner*—L. Heyman
*Attorney, Agent, or Firm*—Burns, Doane, Swecker & Mathis

[57] ABSTRACT

A compressor integral with a Stirling engine having a pressure space comprises a housing, a partition wall provided in the housing, a first pressure chamber defined in the housing at one side of the partition wall and connected with the pressure space of the Stirling engine, and a second pressure chamber defined in the housing at the other side of the partition wall and connected with the first pressure chamber via an orifice. A rod passes through the partition wall and has a first end and a second end located in the first pressure chamber and the second pressure chamber, respectively. A third pressure chamber is defined by a first plate which is connected to the first end of the rod and a first bellows located between the first plate and the partition wall. A fourth pressure chamber is defined by a first plate which is connected to the second end of the rod and a second bellows located between the second plate and the partition wall. First and second passages are formed in the partition plate, and an intake valve device is provided for establishing fluid communication between the first passage and either the fourth pressure chamber or the third pressure chamber whichever is under expansion. A discharge valve device is also provided for establishing fluid communication between the second passage and either the fourth pressure chamber or the third pressure chamber whichever is under compression.

13 Claims, 2 Drawing Sheets

COMPRESSOR INTEGRAL WITH STIRLING ENGINE

BACKGROUND OF THE INVENTION

1. Field of the Invention

The present invention relates to a compressor which is integral with a Stirling engine.

2. Description of the Prior Art

One of compressors of the kind is disclosed, for example, in the U.S. Pat. No. 5,088,284 granted to Momose et. al. The conventional compressor includes a first pressure chamber communicating with a compression space of a Stirling engine, a second pressure chamber connected with a heat pump circuit via valves, a first buffer chamber communicating with the compression space of the Stirling engine via a first orifice, and a second buffer chamber connected with the second pressure chamber via a second orifice. The first pressure chamber is separated from the second pressure chamber by a first diaphragm. The first buffer chamber is separated from the second buffer chamber by a second diaphragm. The two diaphragms are connected together by a rod such that they move together in the axial direction. In the foregoing structure, the compressor acts as a compressor means for the heat pump circuit.

In order to ensure a stable operation of the compressor, the second buffer chamber is an essential element. However, on the other hand, the second buffer chamber is regarded as a dead capacity or an invalid capacity, which leads to less efficiency of the compressor.

SUMMARY OF THE INVENTION

It is, therefore, an object of the present invention to provide a compressor which is integral with a Stirling engine without the foregoing drawbacks.

It is another object of the present invention to provide a Stirling engine which is of more efficiency in comparison with the conventional one.

In order to achieve these objects, there is provided a compressor integral with a Stirling engine having a pressure space which comprises a housing, a partition wall provided in the housing, a first pressure chamber defined in the housing at one side of the partition wall and connected with the pressure space of the Stirling engine, a second pressure chamber defined in the housing at the other side of the partition wall and connected with the first pressure chamber via an orifice, a rod passing through the partition wall and having a first end and a second end located in the first pressure chamber and the second pressure chamber, respectively, a third pressure chamber defined by a first plate connected to the first end of the rod and a first bellows between tile first plate and the partition wall, a fourth pressure chamber defined by a first plate connected to the second end of the rod and a second bellows between the second plate and the partition wall, a first passage formed in the partition plate, a second passage formed in the partition plate, an intake valve device for establishing fluid communication between the first passage and either the fourth pressure chamber or the third pressure chamber whichever is under the expansion, and a discharge valve device for establishing fluid communication between the second passage and either the fourth pressure chamber or the third pressure chamber whichever is under the compression.

BRIEF DESCRIPTION OF THE DRAWINGS

Additional objects and advantages of the present invention will become more apparent from the following detailed description of preferred embodiments thereof when considered with reference to the attached drawings, in which.

DETAILED DESCRIPTION OF THE INVENTION

Figure 1:
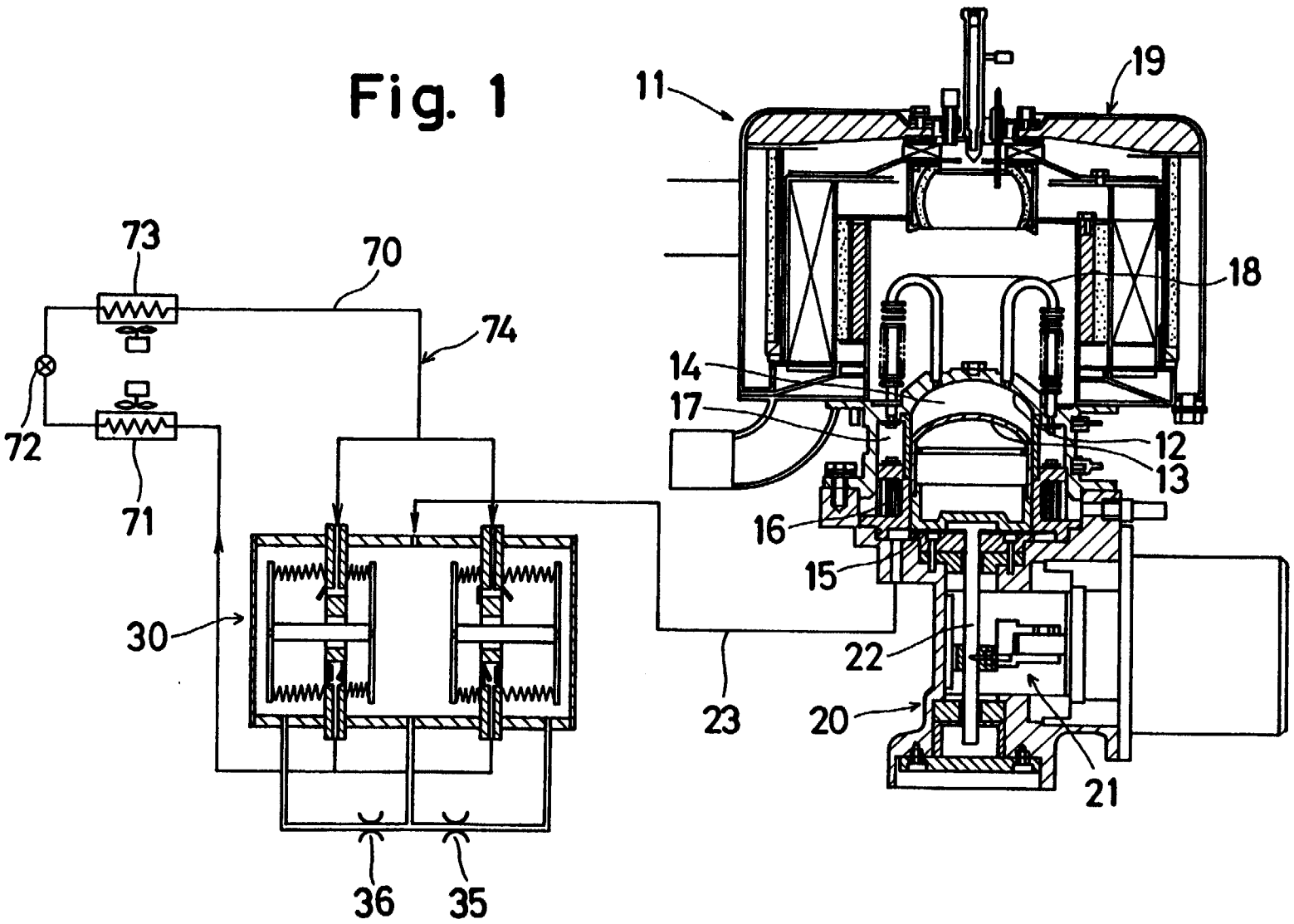
FIG. 1 is a cross-sectional view of a compressor integral with a Stirling engine in accordance with the present invention.

Referring first to FIG. 1, a Stirling engine 11 includes a cylinder 12 in which a piston 13 is movably fitted. At an upper side and a lower side of the piston 13 in the cylinder 12, there are formed an expansion space 14 and a compression space 15, respectively. Around the cylinder 12, a cooler 16 and a regenerator 17 are disposed. The expansion space 14 is in fluid communication with the the compression space 15 via a plurality of heater tubes 18, the regenerator 17 and the cooler 16 which are arranged in such order. The plural heater tubes 18 are located within a heater 19 which is in the form of a recess configuration in order that the plural heater tubes 18 are expected to be heated by combustion heat generated in the heater 19. An amount of operating or working fluid such as a helium gas is filled within an operating space which ranges from the expansion space 14 to the compression space 15. Below the cylinder 11, there is provided a crank case 20 in which a driving mechanism 21 is accommodated. The driving mechanism 21 is connected via a rod 22 to the piston 13 for the reciprocal movement thereof in the vertical direction.

Figure 2:
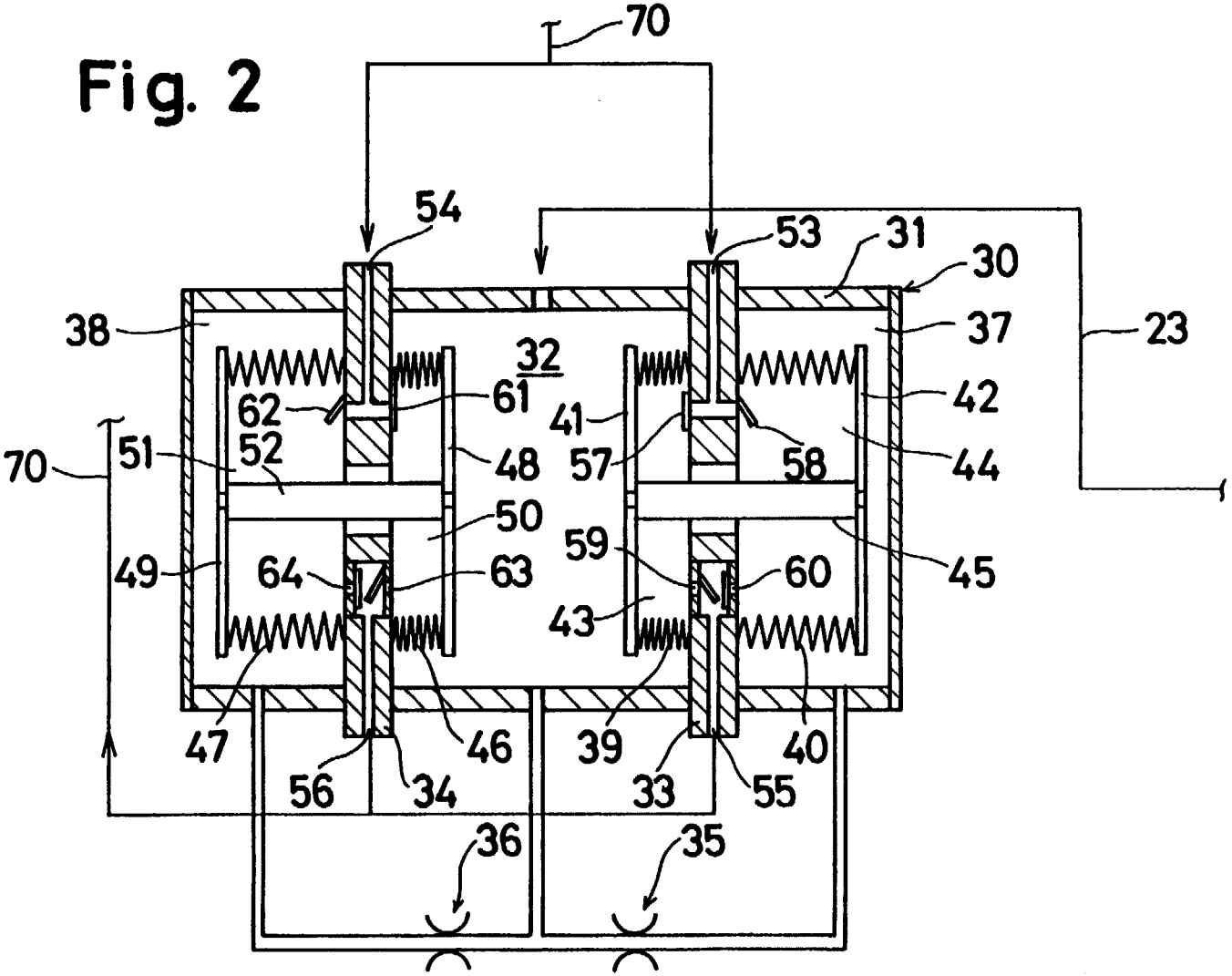
FIG. 2 is an enlarged cross-sectional view of a main portion of the device shown in FIG. 1.

As best seen in FIG. 2, a compressor 39 has a housing 31 in which a first pressure chamber 32 and a pair of separated second chambers 37 and 38 between which the first pressure chamber 32 is located. A partition wall 33 (34) is used for separating the first camber 31 from the second chamber 37 (38) in fluid-tight manner. The first pressure chamber 32 is in fluid communication with the compression chamber 15 via a passage 23. The second pressure chamber 37 (38) is connected to the first pressure chamber 32 via an orifice 35 (36). At opposite ends of a rod 45 (52) passing through the partition wall 33 (34), there are secured a pair of respective plates 41 and 42 (48 and 49) each of which is in parallel with the partition wall 33 (34). Between the plate 41 (48) and the partition wall 33 (34), there is disposed a bellows 39 (46) in order to define a third chamber 43 (50). Between the plate 42 (49) and the partition wall 33 (34), there is disposed a bellows 40 (47) in order to define a fourth chamber 44 (51). It is to be noted that between the rod 45 (52) and the partition wall 33 (34) there is disposed a sealing means (not shown) for the prevention of a fluid communication between the third pressure chamber 43 (50) and the fourth pressure chamber 44 (51).

In the partition plate 33 (34), there is formed an intake passage 53 (54) and a discharge passage 55 (56). The intake passage 53 is connected via valves 57 and 58 to the third pressure chamber 43 and the fourth pressure chamber 44, respectively. The discharge passage 55 is connected via valves 59 and 60 to the third pressure chamber 43 and the fourth pressure chamber 44, respectively. Similarly, the intake passage 54 is connected via valves 61 and 62 to the third pressure chamber 50 and the fourth pressure chamber 51, respectively. The discharge passage 56 is connected via valves 63 and 64 to the third pressure chamber 50 and the fourth pressure chamber 51, respectively. The intake passages 53 and 54 are connected with the discharge passages 55 and 56 via a coolant pipe 70 along which an evaporator 73, an expansion valve 72, and a condenser 71 are arranged in such order. Thus, the third pressure chamber 43 (44) and the fourth pressure chamber 50 (51) serve as a compressor means which constitutes a heat pump circuit 74 together with the evaporator 73, the expansion valve 72, and the condenser 71. In the heat pump circuit 74, an amount of coolant such as a helium gas is filled.

While the Stirling engine 11 is in operation, the pressure in the pressure chamber 15 is found to be in variation which moves along a substantial sine curve. The resultant pressure variation is transmitted via passage 23 to the first pressure chamber 32. Since the second pressure chamber 37 (38) is in fluid communication with the orifice 35 (36), the average pressure inside the first pressure chamber 32 is expected to be generated in the second pressure chamber 37 (38).

If the pressure in the first pressure chamber 32 is greater than the average pressure in the second pressure chamber 37 (38), pressure applied to the plate 42 (48) is greater than that to the plate 41 (49), which results in an expansion of the bellows 39 (47) and a compression of the bellows 40 (46) as seen from FIGS. 1 and 2. Thus, the volume of the third pressure chamber 43 (50) is decreased and the volume of the fourth pressure chamber 44 (51) is increased, which leads to that the coolant in the third pressure chamber 43 (50) is compressed and is discharged or excluded to the condenser 71 via the valve 59 (63) and the discharge passage 55 (56). On the other hand, the coolant is introduced into the fourth pressure chamber 44 (51) from the evaporator 73 via the valve 58 (62) and the intake passage 53 (54).

When the pressure in the first pressure chamber 32 becomes less than the average pressure in the second pressure chamber 37 (38), pressure applied to the plate 42 (48) is less than that to the plate 41 (49), which results in an compression of the bellows 39 (47) and an expansion of the bellows 40 (46). Thus, the volume of the third pressure chamber 43 (50) is increased and the volume of the fourth pressure chamber 44 (51) is decreased, which leads to that the coolant is introduced into the third pressure chamber 43 (50) from the evaporator 73 via valve 57 (61) and the intake passage 53 (54). On the other hand, the coolant in the fourth pressure chamber 44 (51) is compressed and is to be excluded or discharged to the condenser 71 via the valve 60 (64) and the discharge passage 55 (56).

Thus, the pressure variation in the first pressure chamber 32 establishes a repetition of the intake and the discharge of the coolant into and from each of the third pressure chamber 43 (50) and the fourth pressure chamber 44 (51), which results in the operation of the heat pump circuit 74. Since the principle of the heat pump 74 per se is well known, which omits the explanation thereof.

It is to be noted that while each of the Stirling engine 11 and the compressor 30 is at rest the volume of the third pressure chamber 43 (50) should be identical to that of the fourth pressure chamber 44 (51). So long as this condition is being complied with, any modification other than the illustrated structure is available.

As mentioned above, in accordance with the present invention, both the third pressure chamber and the fourth camber are related to the compression of the coolant, which results in the elimination of the dead capacity in the compressor.

The principles, preferred embodiments, and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed:

1. A compressor integral with a Stirling engine having a pressure space, comprising:

a housing;

a partition wall provided in the housing;

a first pressure chamber defined in the housing at one side of the partition wall and connected with the pressure space of the Stirling engine;

a second pressure chamber defined in the housing at an opposite side of the partition wall and connected with the first pressure chamber via an orifice;

a rod passing through the partition walk, said rod having a first end portion located in the first pressure chamber and a second end portion located in the second pressure chamber;

a third pressure chamber defined by a first plate connected to the rod adjacent the first end portion and a first bellows disposed between the first plate and the partition wall;

a fourth pressure chamber defined by a second plate connected to the second end portion of the rod and a second bellows disposed between the second plate and the partition wall;

a first passage formed in the partition wall;

a second passage formed in the partition wall;

intake valve means for establishing fluid communication between the first passage and whichever of the fourth pressure chamber and the third pressure chamber is under expansion; and discharge valve means for establishing fluid communication between the second passage and whichever of the fourth pressure chamber and the third pressure chamber is under compression.

2. A compressor in accordance with claim 1, wherein the first passage and the second passage are incorporated in a heat pump circuit.

3. A compressor integral with a Stirling engine having a pressure space, comprising:

a housing;

a first chamber defined in the housing and receiving a variable pressure from the pressure space of the Stirling engine;

a second chamber defined in the housing and being connected to the first chamber via an orifice;

a third chamber whose volume is variable depending on the pressure in the first chamber;

a fourth chamber whose volume is variable depending on the pressure in the second chamber; and valve means for allowing a coolant to flow into and be discharged from the third and fourth chambers when the third chamber and the fourth chamber are compressed and expanded.

4. A compressor integral with a Stirling engine having a pressure space, comprising:

a housing;

a first chamber defined in the housing and receiving a variable pressure in the pressure space of the Stirling engine;

a second chamber defined in the housing and being connected to the first chamber via an orifice; and means for introducing and discharging a coolant with respect to the second chamber depending on a pressure difference between the first chamber and the second chamber.

5. A compressor in accordance with claim 4, including another second chamber connected to the first chamber via an orifice.

6. A compressor in accordance with claim 1, wherein said intake valve means is positioned in said partition wall.

7. A compressor in accordance with claim 1, wherein said discharge valve means is positioned in said partition wall.

8. A compressor in accordance with claim 3, including two spaced apart partition walls between which is defined the first chamber, said second chamber being defined between an end wall of the housing and one of the partition walls.

9. A compressor in accordance with claim 8, wherein said valve means are positioned in one of said partition walls.

10. A compressor in accordance with claim 8, wherein said third and fourth chambers are positioned on opposite sides of one of said partition walls.

11. A compressor in accordance with claim 4, including a first plate positioned in the first chamber for defining a third chamber and a second plate positioned in the second chamber for defining a fourth chamber.

12. A compressor in accordance with claim 11, wherein said first and second chambers are separated by a partition wall, said first and second plate being movably connected to said partition wall by movable connection means.

13. A compressor in accordance with claim 12, including valve means positioned in the partition wall for introducing coolant into and discharging coolant from the third and fourth chambers.

* * * * *